United States Patent [19]

Koelsch

[11] Patent Number: 5,067,182

[45] Date of Patent: Nov. 26, 1991

[54] SWIMMING POOL COVER

[76] Inventor: Lester M. Koelsch, 1100 Via Formia, Punta Gorda, Fla. 33950

[21] Appl. No.: 563,029

[22] Filed: Aug. 3, 1990

[51] Int. Cl.[5] ..... E04H 4/00

[52] U.S. Cl. ..... 4/498

[58] Field of Search ..... 4/494, 495, 498, 503, 4/581, 582, 583; 16/366, 262; 5/417, 420, 446; 160/229.1, 135

[56] References Cited

U.S. PATENT DOCUMENTS

| | | | |
|---|---|---|---|
| 328,342 | 10/1885 | Robinson | 160/135 X |
| 1,505,593 | 8/1924 | Fryer | 16/366 |
| 1,659,928 | 2/1928 | Townsend | 16/366 X |
| 2,978,020 | 4/1961 | Paulsrude | 160/229.1 X |
| 3,405,410 | 10/1968 | Oldshue | 4/498 |
| 3,683,428 | 8/1972 | Morris | 4/498 |
| 3,872,522 | 3/1975 | Bennett et al. | 4/498 |
| 3,889,315 | 6/1975 | Stouffer | 160/135 X |
| 4,236,259 | 12/1980 | Wendt | 4/498 |
| 4,422,192 | 12/1983 | Jacobs | 4/498 |
| 4,573,513 | 3/1986 | Small et al. | 160/135 |
| 4,825,930 | 5/1989 | Lindberg et al. | 160/135 |
| 4,862,537 | 9/1989 | Riley | 5/446 |

FOREIGN PATENT DOCUMENTS

| | | | |
|---|---|---|---|
| 2004656 | 8/1971 | Fed. Rep. of Germany | 4/498 |
| 2260679 | 10/1975 | France | 4/498 |

*Primary Examiner*—Henry J. Recla
*Assistant Examiner*—Robert M. Fetsuga
*Attorney, Agent, or Firm*—Gifford, Groh, Sprinkle, Patmore & Anderson

[57] ABSTRACT

A modular floating swimming pool cover includes a series of buoyant panels which are hinged together to form a row of panels. The cover can include several adjacent rows. The hinge includes spaced hinge links which fit into slots in the panel ends allowing alternate direction or accordion folding for vertical stack storage and ease in swinging into a use position floating on the liquid surface of the pool.

19 Claims, 2 Drawing Sheets

SWIMMING POOL COVER

BACKGROUND OF THE INVENTION

1. Field of the Invention

This invention relates to a protective swimming pool cover, and more particularly, to an insulating swimming pool cover which includes a number of individual buoyant panels which are hinged together for easy installation from a folded, stacked storage position to a use position covering the pool.

2. Description of the Prior Art

Swimming pool covers are commonly used when a pool is not being used to prevent contamination by debris and the like, to reduce water evaporation and loss of purifying chemicals, and to guard against unauthorized use or at least to advise the observer that the pool is closed to use.

While some swimming pool covers are custom made in one piece or are fabricated and require complicated lifting mechanisms, more conventionally plastic sheets are used. These sheets must be anchored or tied down along the top surface of the pool edge or deck Because the sheets are heavy, particularly as water collects on the top and are cumbersome, the process or removing and applying the sheets becomes so laborious and time consuming that the cover is usually only applied for off season protection or at best when the pool is closed down for an extended time The plastic sheet or canvas cover also usually requires several people for removal or application. In an attempt to overcome these disadvantages, several reel type mechanisms are offered to "roll up" the pool cover. Unfortunately, these are expensive, and do not eliminate many other serious defects of this type of cover. For example, the covers are subject to becoming brittle and to tearing due to weathering conditions, and this is accentuated when a rolling mechanism applies tension to one end of the sheet. Furthermore, the use of a sheet cover does not address a particularly important aspect, namely, that of insulating the pool water from the atmosphere. It is well known and apparent that if the water surface of the pool is insulated during the cooler night portion of the day when there is a net heat loss to atmosphere, that less heat needs to be added to the water to establish a comfortable use temperature.

Insulating pool covers have been introduced in the past, and some of these have used a polystyrene or polyurethane foams. Furthermore, some of these insulating covers have been provided as a series of section or panels, but these have met with little success. Covers made up of a series of unconnected panels can be as time consuming to handle as a sheet cover. Lacing or joining panels together by an adhesive tape has also been commercially unsuccessful. The utility of a modular floating pool cover can only be realized when the cover can stand the rigor of daily or frequent application and removal.

DETAILED DESCRIPTION OF THE PRESENTLY PREFERRED EMBODIMENTS

The present invention provides a modular insulating pool cover utilizing a series of buoyant rectangular panels which are hinged together Thus the energy saving and the other accompanying advantages of an insulating cover are realized. Further the modular cover of this invention is so easily applied and removed with space saving storage that its frequent or daily use is encouraged. The disadvantage of a sheet cover and prior floating section covers have been eliminated.

The protective floating pool cover of the invention uses a series of buoyant rectangular panels which have transversely extending parallel ends and longitudinally extending parallel sides. The ends have a hinged portion. A hinge link is received in the hinge portions of adjacent panels. Each link has spaced hinge pin apertures. A hinge pin is received in the hinge portion of the panel and each of the hinge pin apertures of the link so as to pivotally join the ends of adjacent panels This allows the panels to be swung from a storage position in which the panels are folded over in an accordion fashion one on top of the other to an open use position floating on the water surface of a pool with the ends adjacent each other and the panels in alignment with each other The ends are preferably rounded to provide the necessary swinging clearance for the panels. The rounded ends are preferably in contact when the panels are in their use position.

The panels are made with an expanded polymer which can be a foamed polystyrene or polyurethane. The panels can be extruded or molded. In the preferred embodiment the panels have a protective coating such as an acrylic latex. The panels can be cut to conform with the shape of the pool. A number of rows of hinged together panels can be used with the sides of the panels touching in adjacent rows to make up the entire pool cover.

In a preferred embodiment of the invention, the hinge portion of the panel includes a number of spaced apart slots in the panel ends each of which receives an end of the hinge link so that the hinge pin passes through the material of the panel and one of the apertures in each of the hinge links The hole for accomodating the hinge pin in the panel can be predrilled or molded.

In another preferred embodiment of the invention, an extrusion is attached to each end of the panel. The extrusion protects the end of the panel and provides the spaced apart slots which receive the hinge links. The extrusion also has an integrally molded hinge tube to accomodate the hinge pin.

Although the invention will be described with specific reference to swimming pools, the features of the cover are equally useful with hot tubs and water reservoirs. Also the cover is useful with various forms of reservoirs and tanks containing liquids other than water. The word "pool" is used to denote various relatively large containers of liquid.

DRAWING

The objectives of this invention are accomplished by the embodiments disclosed in the following description and illustrated in the drawing in which.

Figure 1:
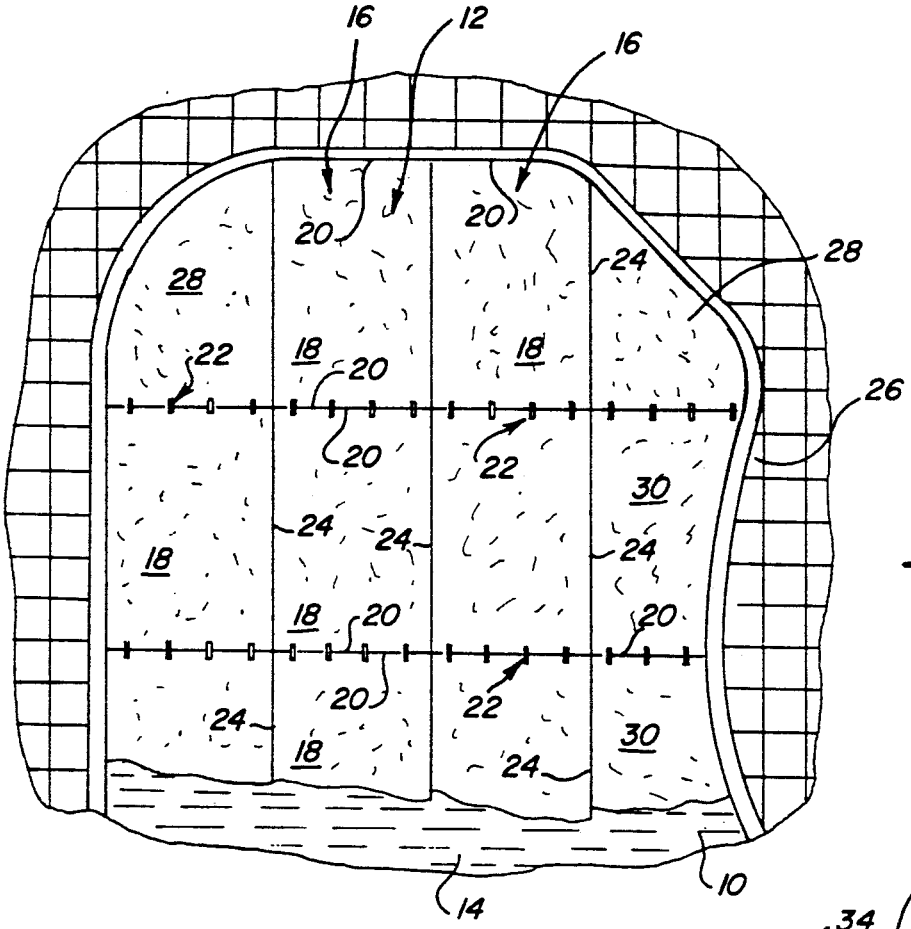
FIG. 1 is a plan view of a portion of a pool showing the pool cover of the invention in place and including a number of rows of hinged tógether buoyant panels.

Referring to FIG. 1, the swimming pool 10 is shown with the protective and insulating floating swimming pool cover 12 of this invention installed in place floating on the water 14 of the pool. The cover 12 includes a number of rows 16 of buoyant panels 18. The panels 18 in each row are hinged together at their adjacent ends 20 by the hinge structure 22. The sides 24 and ends 20 of the outside rows of panels can be cut to conform with the perimeter 26 of the pool as shown by the arcuate cuts in end panels 28 and the more complex curve of side panels 30. Thus by trimming the sides and ends of the outside panels, any size rectangular pool can be accomodated or any special pool contour can be matched. The expanded foam material of the panels can be easily cut as by the use of an electric table knife.

Figure 5:
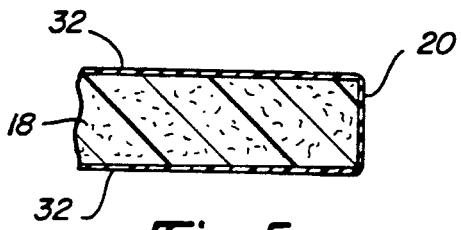
FIG. 5 is a fragmentary cross-sectional view of a panel adapted to receive the extrusions shown in the embodiments of FIGS. 6–8.
Figure 7:
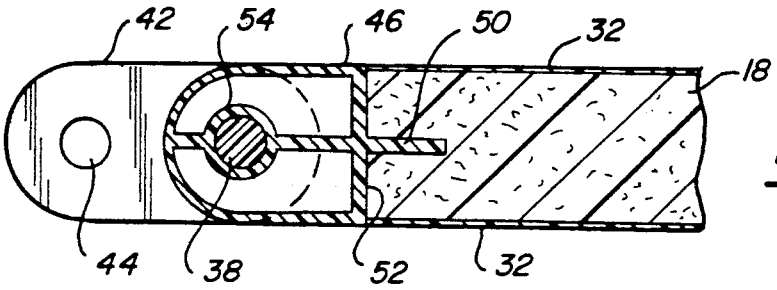
FIG. 7 is a fragmentary cross-sectional view along line 7—7 in FIG. 6 of one end of a panel showing an extrusion in place with a hinge link connected to it by a hinge pin.
Figure 8:
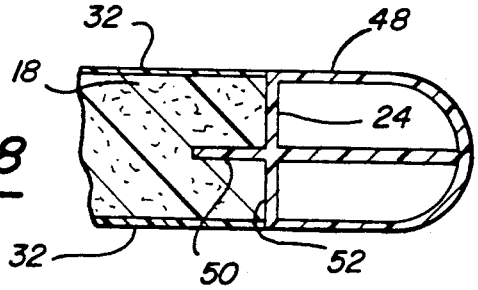
FIG. 8 is a frangmentary cross-sectional view along line 8—8 in FIG. 6 showing an extrusion connected to the side of a panel.

The panels are rectangular, and sizes between 24"×36" and 32"×48" with a 1" thickness provide a panel size that is very easily handled. The panels, of course, can be square and of larger sizes. The thickness can be two inches or more. In any event, the one inch thick panel provides sufficient insulating properties to greatly reduce the heat loss when the pool is covered in the night time. The material is preferably an expanded polystyrene or polyurethane foam. Styrofoam panels are readily available. The faces of the panels are preferably coated as shown at 32 in FIGS. 5, 7 and 8. This seals and provides an ultraviolet barrier to prevent deterioration of the material from sunlight. This protective coating can be of any suitable material such as an acrylic latex which is painted, sprayed, laminated or otherwise applied to the faces of the panel.

Figure 2:
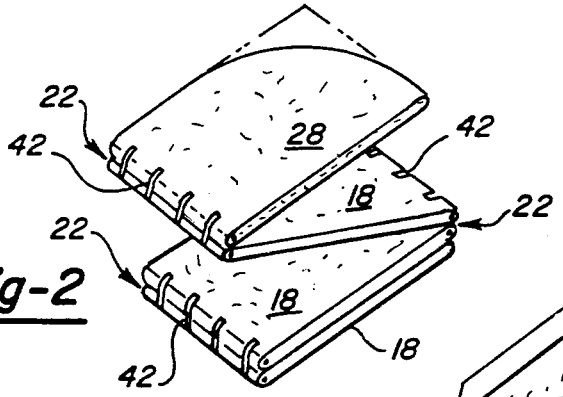
FIG. 2 is a perspective view of a number of hinged together buoyant panels showing the manner in which they can be stacked and folded for use; the top panel shows how the ends and sides of the panel can be contoured to the perimeter configuration of the pool.

As seen in FIG. 2 the hinge structure 22 between adjacent panels is such as to provide complete freedom to swing in either direction until the faces of adjacent panels are in contact. This allows the individual panels to be folded in one direction and then the other direction in an accordion fashion to provide a vertical stack of panels for convenient storage. The stack is merely positioned at one end of the pool and unfolded in the manner shown in FIG. 2 so that it can be slid into the water For example, the stack of panels shown in FIG. 2 can be slid into the water to form the left hand row of panels as viewed in FIG. 1. The subsequent rows of panels that are unfolded and floated into position will have their sides 24 in abutment with each other.

Figure 3:
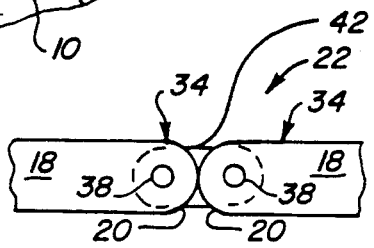
FIG. 3 is a side elevation of a portion of two adjacent panels showing the ends hinged together.
Figure 4:
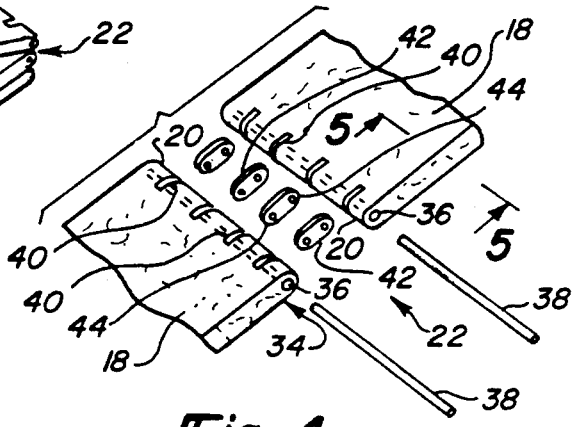
FIG. 4 is an exploded perspective view showing how the hinge structure is assembled.

The hinged structure is best seen in FIG. 3 and 4. The ends 20 of each panel 18 are rounded to provide swinging clearance while the panel ends maintain a line contact or a close spaced relationship with each other.

The hinged portion 34 of each panel has a drilled or molded hinge pin hole 36 to accomodate hinge pins 38. The hinge portion 34 of each panel also has number of spaced slots 40 to accomodate a hinge link 42 in each slot. Hinge links 42 are rounded at their ends and have a pair of spaced apertures 44 which are aligned with the hinge pin holes 36 as the hinge links 42 are inserted in the slots 40 and the ends 20 of adjacent panels are brought together. Hinge pins 38 are then inserted through the hinge pin holes 36 in panels 18 passing through the aligned apertures 44 in hinge links 42 to complete the hinge structure 22.

In the embodiment of FIGS. 5–8 the ends 20 of panel 18 and the sides 24 of the panel 18 are square to receive extrusions 46 and 48 respectively. Extrusions 46 and 48 are made of a suitable plastic material and are attached to the ends and sides of the panels 18 in any convenient manner. For example, the ribs 50 of each extrusion can be pushed into the ends and sides of the panel and adhesive may be applied to the ribs 50 and/or the end faces 52.

Figure 6:
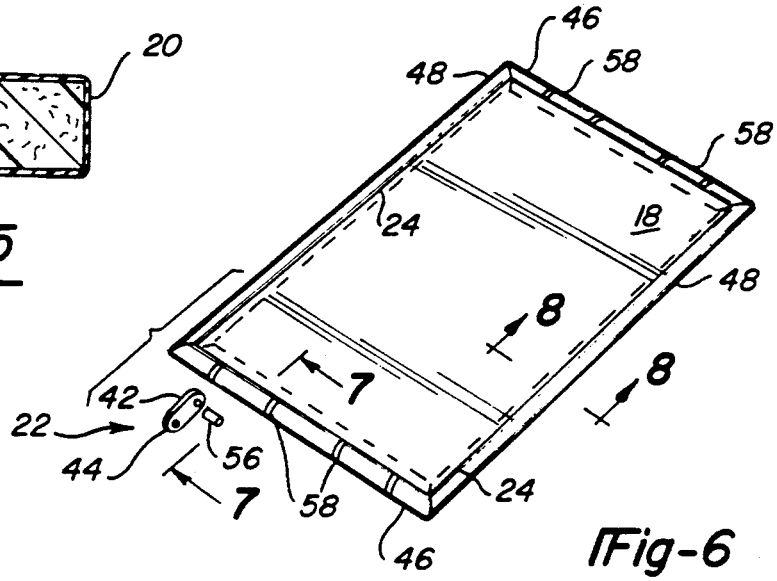
FIG. 6 is an exploded perspective view of another embodiment of the invention employing extrusions at the ends and sides of the panel but utilizing the same hinge link of the prior embodiment.

End extrusion 46 has a hinge tube 54 integrally molded with it to receive the hinge pin 38 through the entire length of the extrusion or to receive individual hinge pins 56 as shown in FIG. 6. End extrusions 46 also have spaced slots 58 to receive hinge links 42 in a manner similar to their being received in slots 40 of the embodiments of FIGS. 2–4. That is, hinge pin apertures 44 are aligned with hinge tubes 54 to receive the hinge pins 38 passing therethrough to complete the hinge structure 22. It will be apparent that the end extrusion 46 can be used in place of side extrusion 48 even though the sides of the panels in adjacent rows are not hinged together Other modifications can be made to the extrusion and hinges within the scope of the claimed invention.

The embodiments of the invention in which an exclusive property or privilege is claimed are defined as follows:

1. A protective floating pool cover comprising:
   - a plurality of buoyant rectangular panels, said panels having parallel ends and parallel sides, said ends having a hinge portion with hinge pin receiving apertures;
   - a hinge link received in the hinge portions of adjacent panels, said hinge links having spaced hinge pin apertures; and
   - a hinge pin received in said hinge pin apertures in said hinge portions and said hinge links, said hinge pin pivotally joining the ends of adjacent panels to permit swinging of any one panel in either direction relative to the adjacent panel until a selected one of either the upper or lower faces of said adjacent panels are in contact with each other, said panels being swingable from a storage position in which said panels are folded over in an accordion fashion, one on top of the other, to an open use position floating on the liquid surface of a pool with the ends adjacent each other and said panels in alignment with each other.

2. The pool cover according to claim 1 wherein said ends of said panels are rounded.

3. The pool cover according to claim 2 wherein the rounded ends of adjacent panels are in contact in said open use position.

4. The pool cover according to claim 1 wherein said panels are made with an expanded polymer.

5. The pool cover according to claim 4 wherein said polymer is polystyrene.

6. The pool cover according to claim 5 wherein said panels are extruded.

7. The pool cover according to claim 5 wherein said panels are molded.

8. The pool cover according to claim 4 wherein said panels have a protective coating thereon.

9. The pool cover according to claim 8 wherein said coating is an acrylic latex.

10. The pool cover according to claim 1 wherein at least one of said panels is cut to conform with the shape of the pool with which it is being used.

11. The pool cover according to claim 1 wherein said cover comprises a plurality of rows of hinged together panels with the sides of said panels being adjacent in adjacent rows.

12. The pool cover according to claim 1 wherein the hinged portion includes a plurality of spaced apart slots each receiving an end of said hinge link with the hinge pin passing through the hinge pin receiving aperatures in said hinge portion and one of the apertures in each of said hinge links.

13. The pool cover according to claim 12 wherein said hinge pin extends substantially the full length of said end of said panel and passes through said hinge pin aperatures in said panel between said slots.

14. A protective floating pool cover comprising:

a plurality of buoyant rectangular panels, said panels having parallel ends and parallel sides, said ends having a hinge portion with hinge pin receiving apertures;

a hinge link received in the hinge portions of adjacent panels, said hinge links having spaced hinge pin apertures;

a hinge pin received in said hinge pin apertures in said hinge portions and said hinge links, said hinge pin pivotally joining the ends of adjacent panels to permit swinging of said panels from a storage position in which said panels are folded over in an accordion fashion, one on top of the other, to an open use position floating on the liquid surface of a pool with the ends adjacent each other and said panels in alignment with each other, said ends of said panel include an extrusion attached to said panel, said extrusion having a plurality of spaced apart slots each receiving an end of said hinge link, and said extrusion having a hinge tube with which one of said hinge pin apertures is aligned for receiving said hinge pin.

15. The pool cover according to claim 14 wherein said extrusion is rounded to provide clearance between adjacent panels when swinging them from said storage position to said use position.

16. The pool cover according to claim 15 further including a rounded extrusion attached to each of said sides and extending between the extrusions attached to said ends.

17. A protective floating cover for a pool comprising:

a first and a second buoyant rectangular panel, said panels having transversely extending parallel ends and longitudinally extending parallel sides;

a hinge pivotally joining one of the ends of said first and said second panels to permit swinging of any one panel in either direction relative to the adjacent panel until a selected one of either the upper or lower faces of said adjacent panels are in contact with each other, said panels being swingable from a storage position in which said panels are folded over on top of one another to an open use position floating on the liquid surface of said pool;

said hinge including a plurality of transversely spaced longitudinally extending slots extending inwardly from each of said panel ends and a hinge pin opening extending parallel to and adjacent each panel end;

a plurality of hinge links each having a pair of spaced hinge pin apertures, one end of each of said links being received in each of said slots along one of said panel ends of said first panel with one of said pair of hinge pin apertures in alignment with said hinge pin opening and the other end of each of said links being received in each of said slots along one of said panel ends of said second panel with the other of said pairs of hinge pin apertures in alignment with said hinge pin opening; and a hinge pin received in each of said hinge pin apertures and said hinge pin openings.

18. A protective floating cover for a pool comprising:

a plurality of buoyant rectangular panels having transversely extending parallel ends and longitudinally extending parallel sides;

a rounded extrusion attached to each end of said panels; and hinge means pivotally joining the ends of said panels to permit swinging of the panels from a storage position in which said panels are folded over on top of one another in an accordion fashion to an open use position floating on the liquid surface of said pool, said hinge means including:

a tubular hinge pin socket integrally molded in said extrusion extending parallel to the end of said panel;

a plurality of longitudinally extending transversely spaced slots molded integrally in said extrusions;

a plurality of hinge links each having a pair of spaced hinge pin apertures, the ends of each of said links being received in the slots of the extrusions of adjacent panels being joined by said hinge means with the hinge pin apertures of said links being in alignment with said hinge pin sockets; and a hinge pin received in each of said hinge pin apertures and said hinge pin sockets.

19. The cover according to claim 18 further including a rounded extrusion attached to each of said sides and extending between the extrusions attached to said ends.

* * * * *